US006773014B2

(12) United States Patent
Lynch

(10) Patent No.: US 6,773,014 B2
(45) **Date of Patent: *Aug. 10, 2004**

(54) GAME OF RUNG-GO

(75) Inventor: James P. Lynch, Sauk Rapids, MN (US)

(73) Assignee: Barry R. Willis, Roseville, CA (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 236 days.

(21) Appl. No.: 09/570,507

(22) Filed: May 13, 2000

(65) Prior Publication Data

US 2002/0084588 A1 Jul. 4, 2002

Related U.S. Application Data

(63) Continuation-in-part of application No. 09/311,998, filed on May 14, 1999, now abandoned.

(51) Int. Cl.[7] ..... A63B 67/00
(52) U.S. Cl. ..... 273/343
(58) Field of Search ..... 273/348, 317, 273/440, 459, 331, 343, 354, 398, 400, 407, 410; 473/569, 575, 576, 476, 477, 438, 446, 451, 454; 463/47.5

(56) References Cited

U.S. PATENT DOCUMENTS 612,173 A 10/1898 Newton
1,075,865 A * 10/1913 Sharp ..... 273/343
2,120,075 A 6/1938 Roosman
2,131,332 A 9/1938 Rose
2,797,924 A * 7/1957 Stewart ..... 273/343
3,701,531 A 10/1972 Bowers
3,717,348 A 2/1973 Bowers
3,774,911 A * 11/1973 Benfield ..... 273/343
3,908,992 A * 9/1975 Cunningham et al. ..... 473/477
4,188,031 A * 2/1980 Fox ..... 473/454
4,487,419 A 12/1984 Welbourn
4,932,657 A * 6/1990 Hailer et al. ..... 473/446
5,165,694 A 11/1992 Kraushaar
5,522,597 A 6/1996 Hanks
5,539,957 A * 7/1996 Schmidt ..... 16/254
5,839,733 A * 11/1998 Meeks et al. ..... 273/400

* cited by examiner

*Primary Examiner*—Raleigh W. Chiu
(74) *Attorney, Agent, or Firm*—Albert W Watkins

(57) ABSTRACT

A game includes ladder-like targets assembled from tubular rods coupled to each other by various tees and angles. The rods are most preferably a rigid, lightweight, weather-resistant material such as PVC or the like. The couplings can be permanent or removable, depending upon the need for storage or shipping after assembly. Each target includes a plurality of rungs, each spaced from each other by a predetermined distance. Projectiles include two relatively massive ends fabricated from balls similar to golf balls, separated by a flaccid cord or rope. In the most preferred embodiment, the spacing between target rungs is one-half the spacing of the projectile massive ends. The rules of play and various alternative embodiments are also presented.

2 Claims, 2 Drawing Sheets

GAME OF RUNG-GO

CROSS REFERENCE TO RELATED APPLICATIONS

This application is a continuation-in-part of U.S. application Ser. No. 09/311,998 filed May 14, 1999, now abandoned and entitled "The Game of Rung-Go".

BACKGROUND OF THE INVENTION

1. Field of the Invention

This invention pertains to games generally, and more specifically to aerial projectiles and targets therefor, as well as methods of playing. Most particularly, the aerial projectiles are balls interconnected by a flaccid material such as a rope or cord, and the target is a set of vertically displaced horizontal bars, about which the cord may wrap.

2. Description of the Related Art

Recreation is a multi-faceted activity that can incorporate many learning and developmental benefits while also serving as a valuable social activity. A good recreational pastime has the potential for simultaneously improving interpersonal communications and offering a release from the stress and pressures of other daily activities. The activity will most desirably accommodate participants of all levels of skill, and offer reward to those who show dedication to the activity, while allowing relatively new participants the opportunity for recreation, enjoyment, and friendly social gathering. It is against this backdrop that the contemplation of desirable activities may be considered, evaluated, and critically assessed. While the merits of any particular activity may be different from one individual to another, the need for valuable recreational activities is universal.

Various aerial toys, where a projectile is tossed towards a target, are known. In several U.S. patents, including U.S. Pat No. 4,487,419 to Welbourn and U.S. Pat. No. 5,165,694 to Kraushaar, each incorporated herein by reference, the projectile consists of a pair of weighted object spaced by a flaccid material, and the target comprises various rods or bars about which the flaccid material may wrap. In the Kraushaar patent, several bags filled with sand or gravel are separated by a flat web of elastic or fabric. The bags are tossed towards a target that includes a plurality of generally horizontal bars that are vertically displaced one from the other. However, the Kraushaar target is partially enclosed within a large solid housing having three solid walls. Whether the housing is fabricated from wood or molded from plastic resins, the housing requires substantial space, weight and expense. Weight makes the invention prohibitive to package and ship, and makes handling the target during use and moving into and out of storage more difficult. The space required for the housing makes retailing, merchandising and inventorying unreasonable. Finally, where the game is desired to be played out of doors, the housing will undesirably catch the wind. Unless securely anchored with extra cords, cables or stakes, the Kraushaar target will be readily toppled in stronger gusts of wind. The sand filled projectiles are also prone to tearing or bursting and the associated scattering of sand.

Welbourn discloses a projectile game directed more towards outdoor participation. A relatively narrow rod is illustrated as being anchored into the ground in an arrangement and fashion similar to a croquet wicket. Two stakes on either side of the target extend down into the ground for anchoring, and a rod of various geometries extends therebetween, spaced above the level of the ground. A course roughly in the shape of a FIG. 8 is laid out just as in croquet, and the contestants work their way through the course by wrapping the aerial projectiles upon the targets. The targets are described as being of a single length of permanently bent structural material such as metallic rod, molded resin, etc. Only one rod is provided for each target, and a multitude of rods are necessary to form a course. Much like croquet, a relatively large course must be established, and the rods are custom formed in a relatively expensive production process.

Three additional patents illustrate various projectiles and tree-like targets, including U.S. Pat. Nos. 3,701,531 and 3,717,348 to Bowers; and U.S. Pat. No. 5,522,597 to Hanks, the contents of which are each incorporated herein by reference. The Hanks patent uses a stick for tossing the projectile, which is much more difficult and unpredictable, adding therefore undesirably to the complexity of the game. The Bowers patents each illustrate a projectile having a tossing handle formed integrally with the flaccid material, midway between projectile balls. This type of handle makes the balls travel through At the air unpredictably, not spreading out well. Consequently, the projectile will pass over and stay wrapped onto the pointed "branches" of the tree more readily than wrapping around a rod. Unfortunately, the tree structure is less desirable, since the branches are anchored at only one end and so are more prone to breakage, while the exposed points of the branches may also present more of a hazard to those who might accidentally happen upon the target.

SUMMARY OF THE INVENTION

In a first manifestation, the invention is a recreational apparatus which enables participation by diverse persons of all skill levels and which encourages interpersonal communications and personal development. The apparatus may be disassembled to be stored compactly and re-assembled quickly, and is resistant to the exterior environment. A base provides structural support upon a surface for a ladder. The ladder extends vertically and is fabricated from a lightweight, rigid, resilient tubular material. It includes first and second horizontal rungs and first, second, third and fourth vertical struts. A first coupler retains the first and second vertical struts to a first end of the first horizontal rung. A second coupler retains the third and fourth vertical struts to a second end of the first horizontal rung. A third coupler retains the second vertical strut to a first end of the second horizontal rung. A fourth coupler retains the fourth vertical strut to a second end of the second horizontal rung distal to the first end of the second horizontal rung. The first, second, third and fourth couplers may be coupled either permanently or removably, depending upon the need for assembly and disassembly, storage, shipment and other similar factors. A plurality of projectiles are included, each having a flaccid spacer and massive terminators at either end of the spacer. The projectile may be tossed to the ladder and subsequently wrapped thereabout, as the game is played.

OBJECTS OF THE INVENTION

A first object of the invention is to enable participation by as many participants as possible, of all skill levels including those highly talented as well as those more physically challenged. Participation by all skill levels ensures enjoyment and recreation regardless of the participants. A second object of the invention is to enable comparable enjoyment of the activity relatively independently of external and uncontrollable factors such as wind. A third object of the invention is that the activity be simple to learn, so that new participants of all ages and skills can join in without embarrassment or detriment that might otherwise discourage their participation. Another object of the invention is the use of low-cost source materials that are light in weight, durable and weather resistant. A further object of the invention is to be able to easily package for storage and transport in a small and compact package, to avoid any shipping constraints and to enable ready warehousing and merchandising. Yet another object is to ensure that the game is easy to set up, most preferably requiring no stakes or cables, so that the set-up doesn't discourage or detract from the game. Another object is to enable play on a wide variety of surfaces, whether perfectly level or not. These and other objects are achieved in the preferred embodiment described below, which will be best understood in conjunction with the appended drawings.

DESCRIPTION OF THE PREFERRED EMBODIMENT

Figure 1:
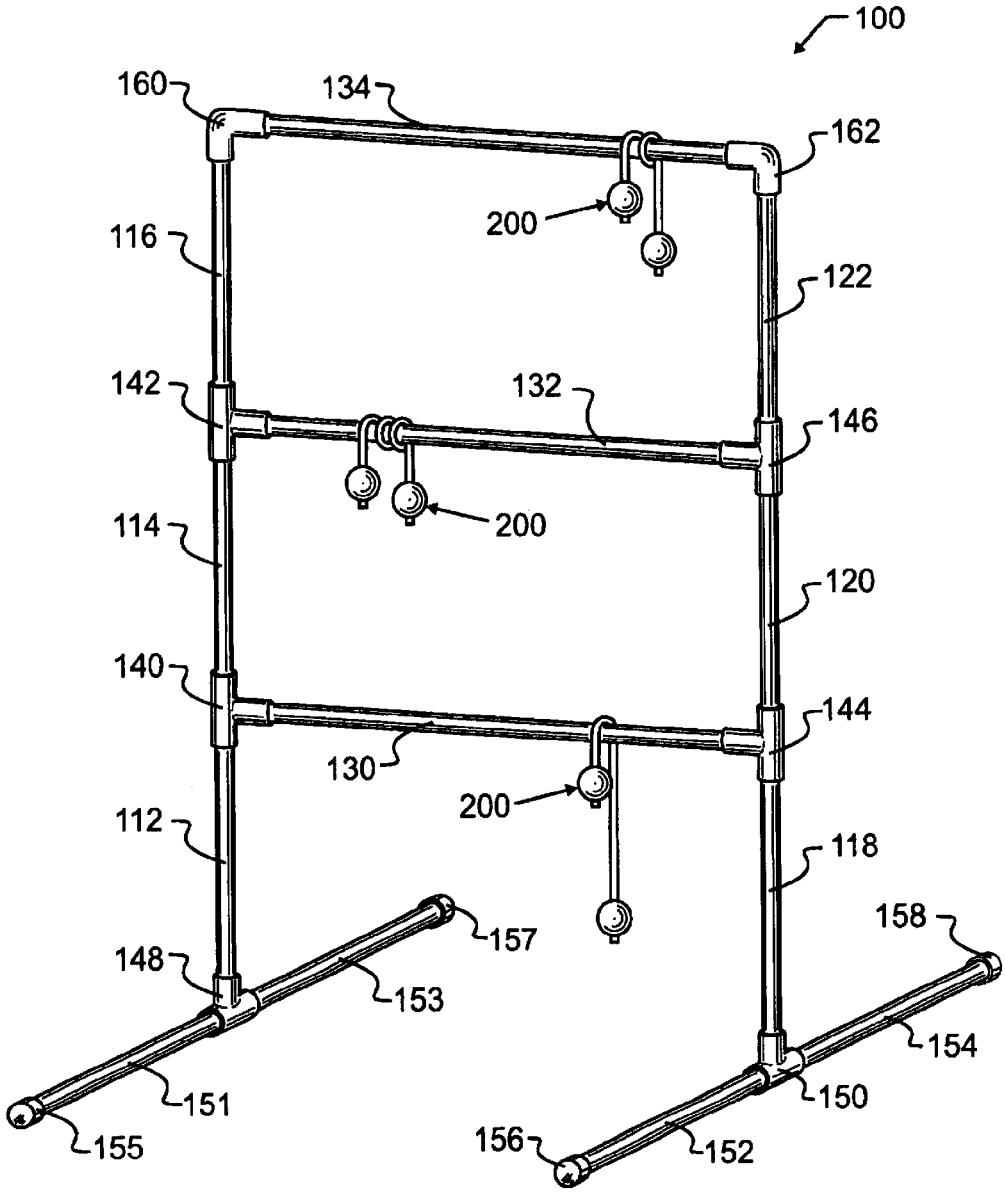
FIG. 1 illustrates a preferred embodiment target designed in accord with the teachings of the present invention, from a projected plan view.
Figure 3:
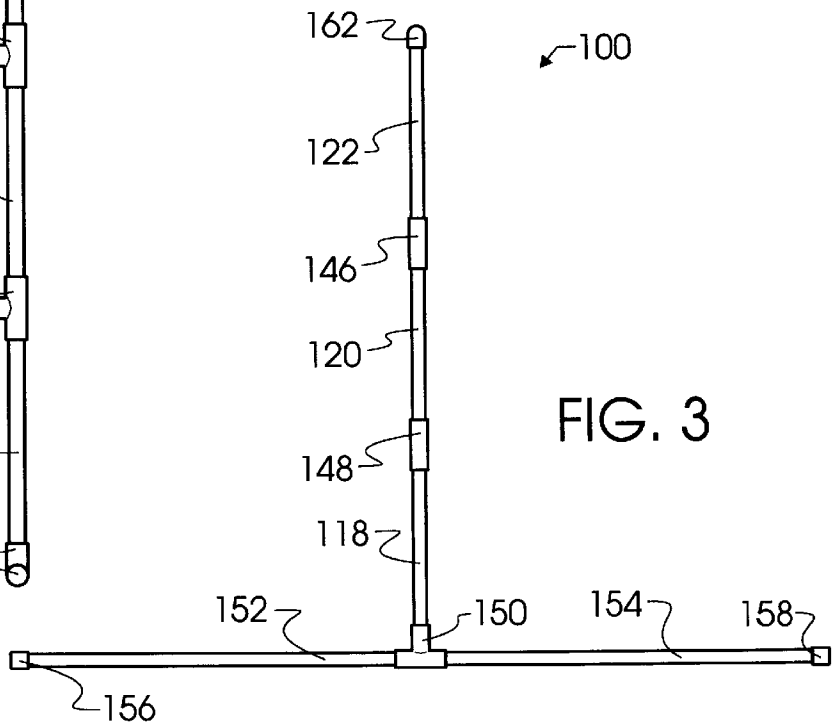
FIG. 3 illustrates the preferred embodiment of FIG. 1 from a side plan view.
Figure 2:
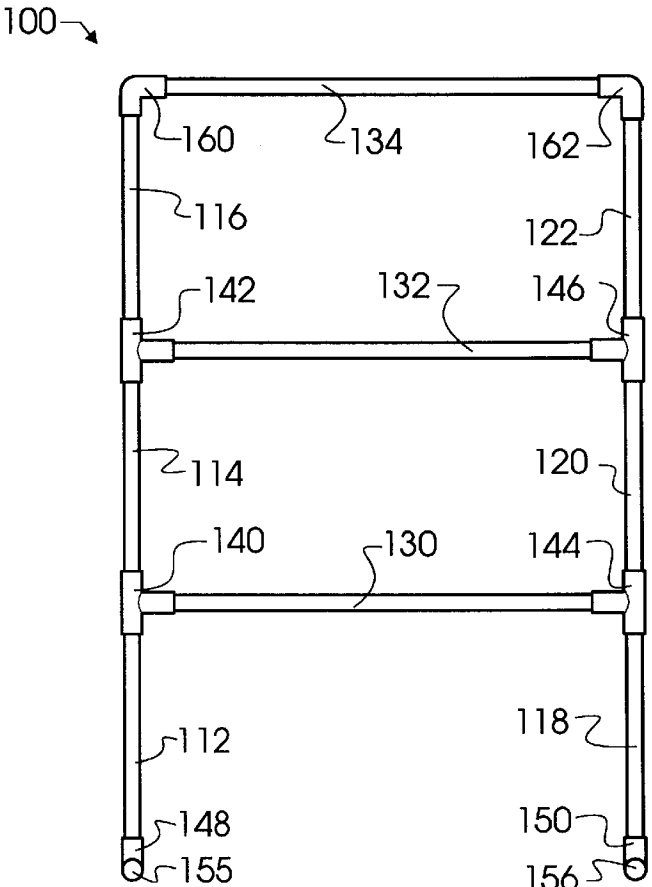
FIG. 2 illustrates the preferred embodiment of FIG. 1 from a front plan view.

A preferred embodiment target 100, shown in FIGS. 1–3, is most preferably fabricated from tubular materials commonly used in the trades for plumbing or electrical applications and referred to as pipe or conduit. This material is generally light of weight and structurally very sound, providing adequate rigidity and resilience. Most preferred materials include polyvinyl chloride (PVC) or similar materials, due to intrinsic weather resistance and the rigidity and resilience aforementioned. Aluminum is a significantly poorer choice of material, due to the greater tendency for aluminum to fracture or crack when hit during the playing of the game, and also due to less stability in the wind and when being hit by the projectile. Segments 112–134 and 151–154 may be manufactured by simply cutting the appropriate lengths of conduit, and performing any edge finishing such as deburring or buffing that may be appropriate for the type of cutting technique used.

Most preferably, and particularly where the target 100 will not be factory assembled, segments 112–134 and 151–154 may be color-coded or otherwise labeled with legends distinguishing one segment from another. For example, the scoring method of the present invention, which will be described in more detail hereinbelow, most preferably involves different points assigned to each one of horizontal segments 130, 132, and 134. This will be most preferably visually distinguished by coloring bands, portions or the whole of these segments in distinct colors, or even manufacturing the game using tubing already intrinsically colored during production. Most preferably, confusion can also be avoided regarding different segments by using only two standard lengths of conduit for segments 112–134 and 151–154. More particularly, segments 130–134 and 151–154 will each be approximately two feet in length, while segments 112–122 will each be approximately one foot long. The lengths will thereby be clearly distinguishable at the time of assembly, and there are only two sizes to distinguish rather than a myriad of lengths. Segments 112–134 and 151–154 may, for these lengths, most preferably by of ¾ inch durable plastic pipe such as the PVC pipe mentioned herein above.

Coupling each segment into target 100 are a number of commercially availablettees 140–150, and two elbows 160–162. As is known in the plumbing and electrical conduit fields, engagement between segments and tees may be readily made simply by sliding a pipe segment into an opening within a tee. The connection between the segments 112–134 and 151–154 and the various tees 140–150 and also elbows 160–162 may be purely frictional, in which case the entire target 100 may be readily disassembled for storage into a most compact package. Alternatively, selected ones of the connections may be frictional, while the remainder are permanently glued. For example, base components 150–158 might be separable from vertical segments 112 and 118 at tees 148 and 150, allowing for flat storage, while all other connections are permanently affixed. This arrangement will require a larger storage space than a fully disassembled collection of components but the assembly time required is minimal, since only two frictional connections will be required, between tee 150 and segment 118 and between tee 148 and segment 112. Where storage space is not an issue at all, or when target 100 will be left ready for use year-round, all of the segment to coupling connections will most preferably be permanently made using a suitable adhesive. Semi-permanent connections may also be used by providing threading or other fastening means at these connections. End caps 155–158 will also most preferably be provided, preventing or limiting the ingress of water or other undesirable materials or creatures into target 100. An additional alternative embodiment which has been conceived of is the provision of hinges which can allow the various leg segments 151–154 to fold up into the same plane as the rest of target 100. Yet another alternative embodiment would permit the two base legs to be swivelled or rotated to the same plane, though this second alternative embodiment does require substantially more width than would be required to hinge or detach the base from the ladder.

Figure 4:
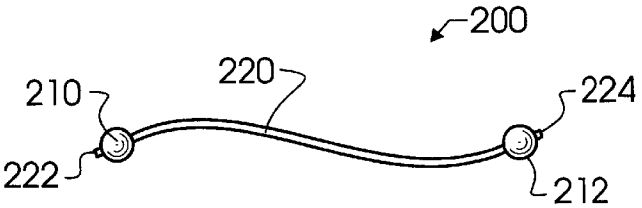
FIG. 4 illustrates a preferred embodiment projectile from a top plan view.

FIG. 4 illustrates the most preferred projectile 200 designed in accord with the teachings of the present invention. A rope or flexible cord 220, such as might be manufactured from ¼ inch nylon rope, interconnects two balls 210,212. In the most preferred embodiment balls 210,212 are comprised by relatively hard and durable balls similar to or possibly comprising golf balls. A small hole will preferably pass through balls 210,212, and, depending upon the volume of production, may be drilled therethrough or molded directly therein. Nylon cord 220 will then be passed through the hole, and can be heat swaged to form ends 222, 224 or alternatively capped or glued or otherwise enlarged and sealed to prevent passage back through balls 210,212. Most preferably, the spacing between balls 210 and 212 will be approximately equal to twice the spacing between each of the horizontal target rods. This spacing makes the center rod relatively more difficult to wrap, as will be described in more detail hereinbelow, than the other two rods. While balls 210, 212 are most preferably round, other shapes and geometries may also be used without interfering with the principles of the invention.

Preferably, the preferred embodiment will include at least two projectiles 200, desirably having different colors. For example, a first projectile 200 might be colored red, while a second projectile 200 will be colored green. The coloring can be achieved either by coloring balls 210,212, or by using colored cord 220, or both, and multiple colors can be used within the same projectile. Nevertheless, it is most desirable that there be multiple distinguishable color combinations. That way, during the play of the game, a person or team's projectile will be easily distinguished from that of an opponent. Most preferably, for each participant or team, there will be a unique color or color combination for projectile 200.

The game will most preferably include two targets 100 spaced approximately thirty feet apart, facing each other. Two color-matched sets of three projectiles 200 will be included. Using this combination of targets 100 and projectiles 200, the game will easily accommodate two or four players. The game is played by participants taking turns tossing the projectile at the target. This will be done most preferably by grasping one of balls 210, 212 with one hand, leaving the other ball to hang like a pendulum. The participant will then swing the grasped ball towards target 100 with an underhand flipping motion, causing balls 210, 212 to spin backward in and end-over-end fashion. When projectile 200 hits target 100, it will wrap around one of the horizontal segments 130, 132, 134, hereinafter referred to as rungs. The toss is believed to be most effective if the lower ball is encouraged to swing gently backwards, then tossed on the return swing forward.

Each of rungs 130–134 may be color coded, as aforementioned, and will represent a particular point value. Middle rung 132 may, for example, be assigned three points, while top rung 134 is assigned two points and bottom rung 130 is assigned one point. When all projectiles 20 are tossed, this is called a frame, and at the end of a frame, the cumulative point values are totaled for each contestant or team. In a manner similar to horseshoes, where an opponent's points can be canceled, the player or team with the most points scores the difference between their points and those of the opponents for that frame. For example, if a first player wraps middle rung 132 with a first projectile and bottom rung 130 with a second projectile, that first player has scored four points. If the opponent wraps top rung 134 only, then the opponent scores two points. The scoring for the frame then will be two points for the first player. At the beginning of each subsequent frame, the player that scored on the previous frame goes first. If none of the players scores, then the players will alternate. Most preferably, the first team to score fifteen points is declared the winner. An alternate embodiment scoring method is to require exactly 15 points to win. The penalty for scoring more than fifteen is to reduce the score by the amount the leader went over. For example, if a player had thirteen points and scored three, then the player would be one over. Consequently, the original thirteen is reduced by one point to twelve points.

Team play can occur by placing one member from each team next to one of the two opposing targets 100. Then, one frame will be played by one member from each team. The players do not have to travel between the targets 100. Instead, the next frame will be played by their team mates, who will be tossing the projectiles 200 back to the target 100 they are standing near. Many other variations are possible in the play and scoring, while still observing the spirit of the invention. Because the participants are side-by-side throughout the play of the game, interpersonal communication is encouraged and supported by the activity, thereby creating a more enjoyable and even relaxing atmosphere of play than can be had in some other forms of competitive or semi-competitive recreation.

While the foregoing details what is felt to be the preferred embodiment of the invention, no material limitations to the scope of the claimed invention are intended. Further, features and design alternatives that would be obvious to one of ordinary skill in the art are considered to be incorporated herein. For example, only one target 100 may be used, and a line spaced from target 100 can be drawn upon the ground to designate the tossing location. In other alternative embodiments, a plurality of targets 100 may be used, and a course may be traversed by the players. While three rungs 130–134 are most preferred, other numbers or combinations of rungs are possible. The scope of the invention is therefore set forth and particularly described in the claims hereinbelow.

I claim:

1. A recreational apparatus which enables participation by diverse persons of all skill levels and which encourages interpersonal communications and personal development and which further may be disassembled to be stored compactly and re-assembled quickly, and which is resistant to the exterior environment, comprising:

a base comprising first and second horizontally extending legs, said first and second legs extending parallel in an operative position for providing structural support upon a surface;

a ladder extending vertically therefrom fabricated from a lightweight, rigid, resilient tubular material, having first and second horizontal rungs and first, second, third and fourth vertical struts;

a first coupler retaining said first and second vertical struts to a first end of said first horizontal rung;

a second coupler retaining said third and fourth vertical struts to a second end of said first horizontal rung distal to said first end of said first horizontal rung;

a third coupler retaining said second vertical strut to a first end of said second horizontal rung;

a fourth coupler retaining said fourth vertical strut to a second end of said second horizontal rung distal to said first end of said second horizontal rung;

said first, second, third and fourth couplers coupling either permanently or removably;

fifth and sixth couplers respectively pivotally attaching said first and second horizontally extending legs to said ladder wherein said first and second horizontally extending legs are pivotal from generally perpendicular to said ladder in said operative position to parallel to said ladder for storage; and a projectile having a flaccid spacer and massive terminators at either end of said flaccid spacer, whereby said projectile may be tossed to said ladder and subsequently wrapped thereabout.

2. The recreational apparatus of claim 1 wherein said first and second horizontally extending legs are non-destructively removable from said ladder for storage.

* * * * *